US007552765B2

(12) United States Patent
Lam

(10) Patent No.: US 7,552,765 B2
(45) Date of Patent: Jun. 30, 2009

(54) WELLHEAD BLOWOUT PREVENTER WITH EXTENDED RAM FOR SEALING CENTRAL BORE

(75) Inventor: Tony M. Lam, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 185 days.

(21) Appl. No.: 11/627,674

(22) Filed: Jan. 26, 2007

(65) Prior Publication Data

US 2007/0175626 A1 Aug. 2, 2007

Related U.S. Application Data

(60) Provisional application No. 60/762,638, filed on Jan. 27, 2006.

(51) Int. Cl.
*E21B 43/11* (2006.01)
*E21B 33/06* (2006.01)

(52) U.S. Cl. ..... 166/85.4; 166/55; 166/55.1; 251/1.3

(58) Field of Classification Search ..... 166/85.4, 166/84.1, 379, 386, 86.3, 84.3, 373, 72, 90.1; 251/1.3, 285, 1.1; 137/415.2, 315.29
See application file for complete search history.

(56) References Cited

U.S. PATENT DOCUMENTS 1,851,894 A 3/1932 Clough
1,866,340 A * 11/1932 King ..... 251/1.3
2,194,260 A 3/1940 Allen
2,385,463 A 9/1945 Penick
2,969,838 A 1/1961 Wilde
3,817,326 A 6/1974 Meynier, III
4,476,935 A 10/1984 Hynes et al.

(Continued)

FOREIGN PATENT DOCUMENTS

CA 1136544 11/1982

(Continued)

OTHER PUBLICATIONS

Double E Inc. "Production blowout Preventer Rams" product catalogue.

(Continued)

*Primary Examiner*—Jennifer H Gay
*Assistant Examiner*—Yong-Suk Ro
(74) *Attorney, Agent, or Firm*—Greenlee Winner and Sullivan PC

(57) ABSTRACT

A blowout preventer (BOP) is provided in which one of the BOP rams is formed with an extended central bore sealing section to seal across the central bore in a central bore closing position when the polish rod is not present. The ram bores of the BOP are sized to accommodate this extended central bore sealing section in any of the open, sealing or central bore closing positions. The front ends of the BOP rams may be adapted to carry elastomeric or thermoplastic seals to seal against the polish rod or against each other. The central bore seals for the extended central bore sealing section may be formed with elastomeric or thermoplastic seals. In the case of thermoplastic seals, the rams and ram bores are adapted to ensure that the thermoplastic seals are compressed outwardly, to seal the ram bores, or are lifted upwardly, to seal the central bore.

16 Claims, 18 Drawing Sheets

U.S. PATENT DOCUMENTS

| | | | | |
|---|---|---|---|---|
| 5,577,556 | A | 11/1996 | Reed | |
| 5,615,736 | A | 4/1997 | Reed | |
| 5,617,917 | A | 4/1997 | Squires | |
| 5,732,777 | A | 3/1998 | Grimshaw et al. | |
| 5,743,332 | A | 4/1998 | Lam et al. | |
| 5,765,813 | A | 6/1998 | Lam et al. | |
| 6,024,172 | A * | 2/2000 | Lee | 166/363 |
| 6,026,898 | A | 2/2000 | Bland et al. | |
| 6,176,466 | B1 | 1/2001 | Lam et al. | |
| 6,192,981 | B1 | 2/2001 | Boquet et al. | |
| 6,223,819 | B1 | 5/2001 | Heinonen | |
| 6,260,817 | B1 | 7/2001 | Lam et al. | |
| 6,457,530 | B1 | 10/2002 | Lam et al. | |
| 6,595,278 | B1 | 7/2003 | Lam et al. | |
| 6,601,650 | B2 | 8/2003 | Sundararajan | |
| 6,719,262 | B2 | 4/2004 | Whitby et al. | |
| 6,739,570 | B2 * | 5/2004 | Carlsen | 251/1.3 |
| 6,843,313 | B2 | 1/2005 | Hult | |
| 7,137,610 | B2 | 11/2006 | Lam | |
| 7,243,713 | B2 * | 7/2007 | Isaacks et al. | 166/85.4 |
| 2005/0045323 | A1 | 3/2005 | Hult | |
| 2007/0175625 | A1 | 8/2007 | Lam | |

FOREIGN PATENT DOCUMENTS

| | | |
|---|---|---|
| CA | 1142427 | 3/1983 |
| CA | 1142428 | 3/1983 |
| CA | 2153612 | 1/1997 |
| CA | 2197584 | 4/1997 |
| CA | 2177629 | 11/1997 |
| CA | 2260655 | 8/2000 |
| CA | 2280581 | 2/2001 |
| CA | 2287593 | 4/2001 |
| CA | 2331579 | 9/2001 |
| CA | 2349988 | 10/2001 |
| CA | 2368877 | 7/2003 |
| CA | 2411129 | 5/2004 |

OTHER PUBLICATIONS

Weltec-Alan "1500# Well Completion Blow-0ut Preventer" product catalogue.

* cited by examiner

WELLHEAD BLOWOUT PREVENTER WITH EXTENDED RAM FOR SEALING CENTRAL BORE

CROSS-REFERENCE TO RELATED APPLICATION

This application claims priority from U.S. Provisional Patent Application No. 60/762,638 filed Jan. 27, 2006, which is incorporated by reference herein to the extent that there is no inconsistency with the present disclosure.

BACKGROUND OF INVENTION

The invention relates to a wellhead blowout preventer (BOP), and more particularly to a production BOP capable of sealing against a polish rod when in place, and against the central bore when the polish rod is not present.

The rams of a BOP may operate in different ways in closing off a well, or multiple BOPs may be used in a wellhead stack to provide different functions. In a production well, polish rod rams seal around a polish rod extending through the wellhead. Blind rams seal against each other across the central bore when no polish rod is in place.

A typical prior art BOP for a production wellhead is disclosed in U.S. Pat. No. 5,765,813 to Lam et al., issued Jun. 16, 1998, owned by Stream-Flo Industries Ltd., the assignee of this patent application. This type of BOP is commonly used in connection with pumping wells. With such wells, a sucker rod string is reciprocated or rotated to drive a downhole pump, which lifts the produced fluid to surface through a tubing string. The BOP is equipped with polish rod rams which can be advanced horizontally to seal around the vertical polish rod of the rod string, to prevent the upward escape of fluid. Alternatively, if the rod string is out of the well, the inner or front ends of the rams can be pressed together to cause closure of the wellhead assembly fluid passageway. Alternatively, the front ends of the rams can be configured as blind rams such that they seal against each other across the central bore when the polish rod is not in place.

More particularly, the prior art BOP includes a cross shaped housing forming a central vertical bore and a pair of coaxial, horizontal ram bores intersecting the central bore from each side. The BOP is commonly positioned in the wellhead assembly between the tubing head and flow tee. In such an embodiment, the BOP central bore forms part of the wellhead assembly fluid passageway. Within the BOP, a pair of rams is positioned in the horizontal ram bores. Means, such as screw jacks or actuators (mechanical, electrical, pneumatic or hydraulic), are provided at the outer ends of the ram bores, for advancing or retracting the rams into or out of the central bore, in order to close or open the central well bore.

Each ram comprises a generally cylindrical body, although other shaped ram bodies are known (ex. oval or square in cross section). The ram body generally comprises a steel core, preferably having an outer full bore diameter portion and a reduced diameter inner portion. The ram core inner portion is covered with and bonded to a layer of an elastomeric material, typically a nitrile rubber.

The ram bores, typically cylindrical, extend into the central bore and the bore surfaces combine at their intersection to form sealing areas. When the rams move into the central bore, the rubber surfaces of their inner portions seal against the sealing surfaces.

The rubber coated inner or front face of each ram is formed to provide a semi circular, vertically directed groove. Thus, when the polish rod of the rod string is present in the central bore, the ram ends encircle and press against it, to form a seal of the central bore. When the polish rod is not in the central bore, the ram ends compress together to form a solid block. In both cases, the circumferential seals of the ram side surfaces, with the sealing areas and the end face seals, combine to close the central bore and contain pressurized fluids.

One major problem associated with production BOP's is that the pressure acting from below on the closed rams may extrude the side rubber upwardly so that the circumferential seal with the sealing areas is lost. Another problem is that the end rubber bonded to the vertical end faces of the ram cores may tear loose from the core when high pressure is exerted from below. In severe conditions, such as injecting chemicals to close off a well, the rubber degrades quickly, causing the seals to fail.

As described in U.S. Pat. No. 5,765,813, the side surface of each ram core inner portion is formed to provide ribs extending outwardly therefrom and extending longitudinally thereof. The ribs are located so as to underlie those portions of the elastomer layer which seal against the sealing areas. The elastomer layer is thinned where it passes over the ribs, to preserve the cylindrical shape of the ram's inner portion. The ribs function to reinforce the elastomer layer against upward extrusion. Comparative pressure tests have shown that a ribbed ram is able to contain several times the pressure that a non ribbed ram could contain, before the seal was lost.

In accordance with a preferred feature of U.S. Pat. No. 5,765,813, the vertical end face of the core inner portion is indented, for example with a plurality of spaced apart transverse grooves or dimples or a single cavity, so that the base of the elastomer layer projects into these indentations. As a result, increased face surface area is provided to bond with the elastomer. In addition, the elastomer external of the indentations must shear from the elastomer in the indentations, before failure occurs and the elastomer separates from the steel. In this way, the resistance to failure of the elastomer/steel bond at the ram end faces is improved. The device of U.S. Pat. No. 5,765,813 improves the ability of the BOP ram to seal against the high pressure from below without losing the side seal, and better prevent against the rubber being torn loose from the ram.

Canadian Patent Application No. 2,260,655, published Aug. 2, 2000, and owned by Stream Flo Industries Ltd., describes a ram type BOP for high temperature applications. The BOP incorporates a generally L shaped seal element formed of a graphite or asbestos seal material, which is sandwiched between a bottom L shaped steel retainer plate and a semi cylindrically shaped steel top retainer plate. This design of BOP ram is well suited for brittle seal materials such as graphite and asbestos, which are used when steaming of the well may occur.

The BOP devices of the above patents do not adequately address all applications involving harsh chemical conditions. Rubber type seal materials (elastomeric seals) are subject to being degraded by the harsh conditions of some wellheads, for example where chemicals are injected. For instance, in wells in which heavy wax deposits accumulate in the annulus, outlet lines, and anywhere that the production fluid flows, a chemical inhibitor is introduced into the production fluid as a means to break down the deposits. While the inhibitor is effective in clearing the lines, it has the major disadvantage of acting as a dissolving agent on the O ring seals, rubber ram inserts and any elastomeric materials found inside the wells, causing these seals to fail prematurely.

Thermoplastic materials having superior chemical resistance are available, but have different compressibility and elastic properties than elastomeric sealing materials such as nitrile rubbers. Thus, the prior art BOP devices are not generally amenable to simple substitution of thermoplastics for the rubber sealing components.

In U.S. Pat. No. 7,137,610, issued Nov. 22, 2006, naming inventor Tony M. Lam, and owned by Stream-Flo Industries Inc., there is described a production BOP, and BOP rams, which incorporate thermoplastic seals at the front of the rams to seal against the polish rod.

There is a need for a production BOP which can reliably seal against a polish rod, but which can also seal the central bore when the polish rod is not in place. This could also eliminate the need for multiple valves and BOPs in a wellhead stack.

SUMMARY OF THE INVENTION

The invention provides, in one broad aspect, a production blowout preventer, comprising:

a housing forming a central bore, which extends vertically through the housing, and a first and a second horizontal ram bore extending radially outwardly in opposite directions through the housing and intersecting the central bore, with sealing surfaces being formed across the wall surfaces at the intersection of the ram and central bores;

a first ram positioned in the first ram bore for sliding movement therealong;

a second ram positioned in the second ram bore for sliding movement therealong;

the first and second rams each including a ram body having front and rear ends, each of the ram bodies being slidable along the ram bores so as to project into the central bore where their front ends are adapted to seal against a polish rod of a rod string extending therethrough, and each of the ram bodies optionally carrying one or more seals for sealing against the ram bore in which it is positioned;

the first ram body including an extended central bore sealing section between its front and rear ends, said central bore sealing section carrying one or more central bore seals for sealing across the central bore when the extended central bore sealing section is positioned across the central bore in a central bore closing position;

the first ram bore being of sufficient length to accommodate the first ram body in a fully extended or fully retracted position;

the second ram bore being of sufficient length to accommodate the second ram body in a fully extended or fully retracted position, and to also accommodate the front end of the first ram when in the central bore closing position; and means connected to the rear of each ram body for advancing and withdrawing the first and second rams between open, sealing and central bore closing positions.

The front ends of each of the first and second rams are adapted to seal against the polish rod, or in the case of a blind ram, against each other, as is well known in the art, including, for example, any of the front end BOP ram seals shown in the patents mentioned herein, and as shown hereinbelow. Thermoplastic or elastomeric seals may be used at the front ends of the first and second rams to seal against the polish rod, or against each other.

The central bore seals of the first ram may take multiple designs and may be made of thermoplastic or elastomeric type materials.

The invention extends to wellhead assemblies including the BOP of this invention alone, or together in an integral composite assembly with one or more other components which might include, in any sequence, adaptors, control valves, additional BOP rams, check valves, flow tee, and polish rod clamp. The wellhead assembly of this invention includes top and bottom connectors for connecting to wellhead components located above and below. Such connectors may be of any type, as is known in the industry, including for example studded connectors, flange connections, welded connections, clamp and threaded connections. Importantly, the BOP of this invention, incorporating the extended first ram with central bore sealing capability, may allow one or more of the extra BOP or shut-off valves in the wellhead or the composite wellhead assembly, to be omitted.

The rams and ram bores may be of any shape or configuration as is known for in the BOP art. While the figures show the rams and ram bores as being cylindrical in cross-section, they may be alternatively shaped, such as oval or rectangular in cross section. As used herein, the term "cylindrical" is understood to include rams and ram bores which are generally circular or oval in cross section.

It should be understood that the terms "inner", "outer", "front", "rear", "back", "upper", "lower", "top" and "bottom", as used herein and in the claims with reference to the wellhead components and the BOP ram or its parts, refer to the component or ram as it is designed to be positioned in one of the horizontal bores, for movement forwardly into the central bore or rearwardly in the horizontal ram bores. By "inner" or "front", as used herein, is meant the portion or end of the ram or its parts at the central bore. By "rear" or "back" is meant the portion or end of the ram or its parts opposite the front. By "outer" is meant the outer circumferential portion of the ram or its parts. An "outwardly" motion is meant to refer to an outward movement (including a rearward and upward motion) of the thermoplastic sealing surface against the horizontal cylindrical bore, so as to seal against the horizontal bore. The term "central" in reference to the "central bore" is not meant to exclude a generally vertical bore which may be somewhat off-centre in the wellhead assembly in which it is included.

"Elastomeric" materials include rubber type seal materials such as nitrile rubber seals. "Thermoplastic" materials include polytetrafluoroethylene (PTFE), ex. Teflon®, but preferably modified with fillers such as carbongraphite or glass, which strengthen the polymers. For environments which expose seals to chemicals, the strengthened thermoplastic polymers are most preferred.

As used herein and in the claims, a reference to "a connection," "connected" or "connect(s)" is a reference to a sealed pressure-containing connection unless the context otherwise requires.

As used herein and in the claims, "comprising" is synonymous with "including," "containing," or "characterized by," and is inclusive or open-ended and does not exclude additional, unrecited elements.

The use of the indefinite article "a" in the claims before an element means that one or more of the elements is specified, but does not specifically exclude others of the elements being present, unless the contrary clearly requires that there be one and only one of the elements.

DETAILED DESCRIPTION OF THE INVENTION

Figure 1:
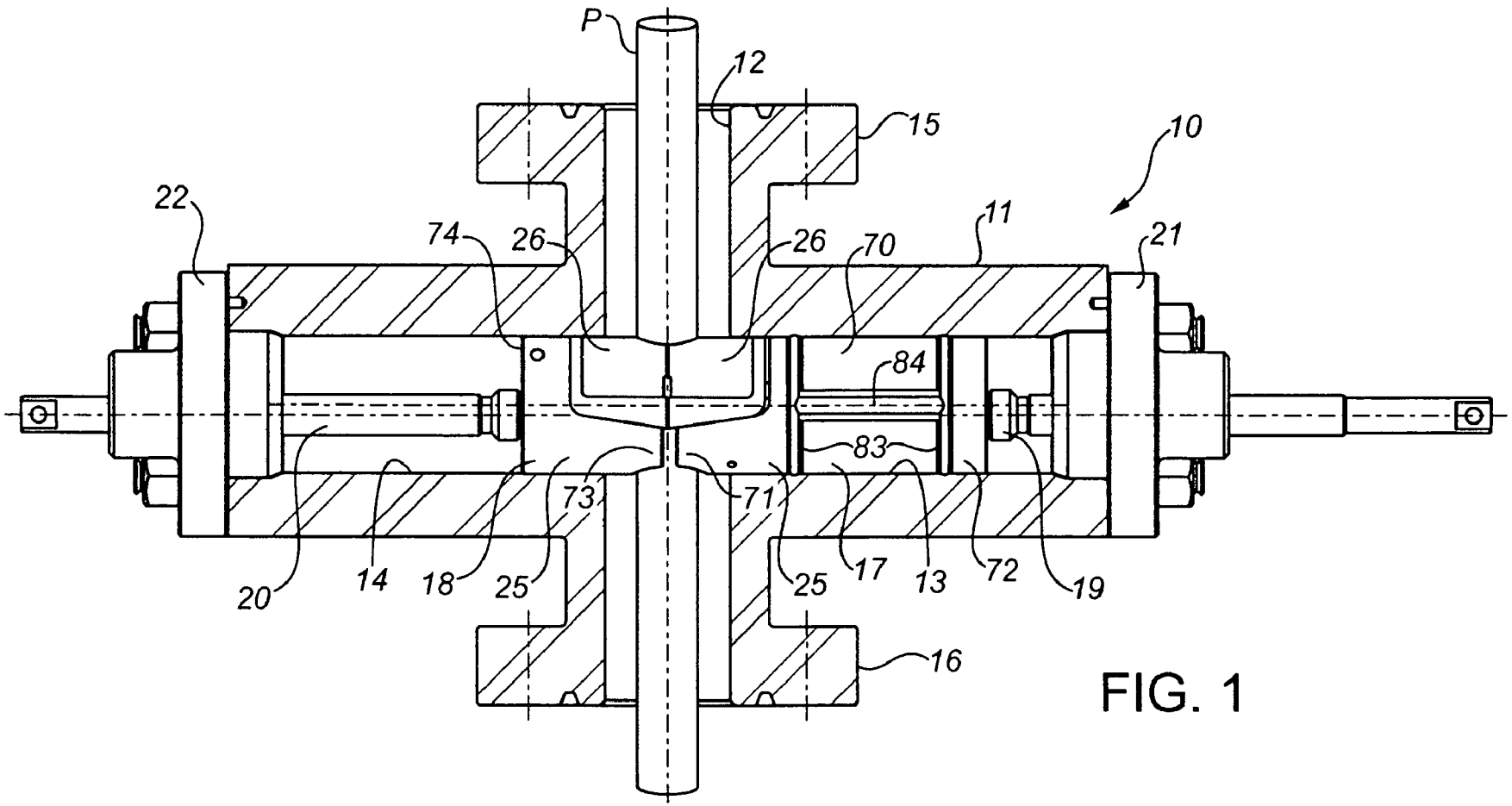
FIG. 1 is a side sectional view of a production blowout preventer (BOP) of this invention with both of the first and second rams in a sealing position against the polish rod, but showing the first ram (on the right) including an extended central bore sealing section.

Multiple preferred embodiments of the production blowout preventer (BOP) of the present invention, or a composite wellhead assembly containing the BOP, are shown in the Figures, with like parts being labeled with the same reference numerals.

Having reference to FIG. 1, a production blowout preventer (BOP) is shown generally at 10, to include a cross shaped steel housing 11 forming a central bore 12, extending vertically through the housing 11, and a pair of co-axial horizontal first and second ram bores 13, 14. The ram bores 13, 14 are slightly larger in diameter than the central bore 12, as is common in BOP devices. Top and bottom flange connections 15, 16 to wellhead components located above and below the BOP 10 are shown, although alternate connections such as threaded, welded, studded, or clamp connections might be used. The horizontal ram bores 13, 14 intersect with the central bore 12. The polish rod P is shown in place in the central bore 12.

Figure 3:
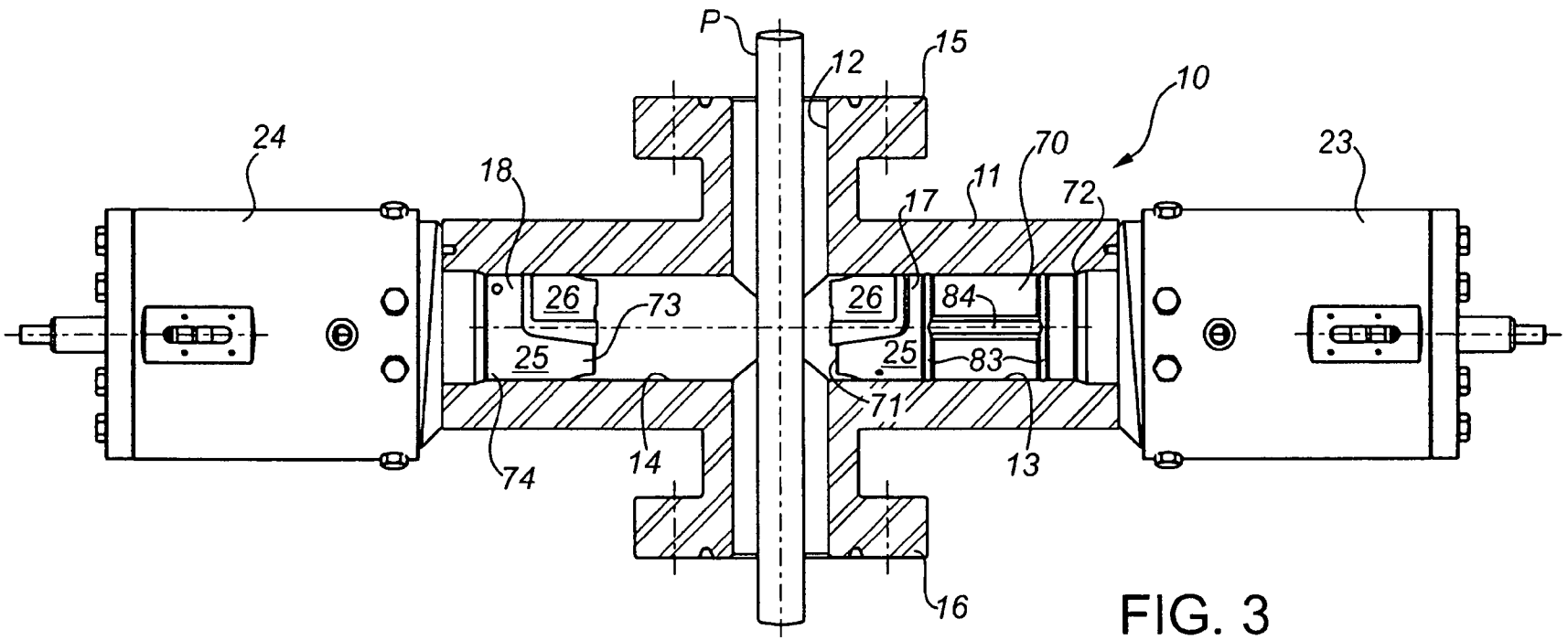
FIG. 3 is a side sectional view of a BOP of FIG. 1, shown with both BOP rams retracted (open), and in which the rams are hydraulically actuated.
Figure 7:
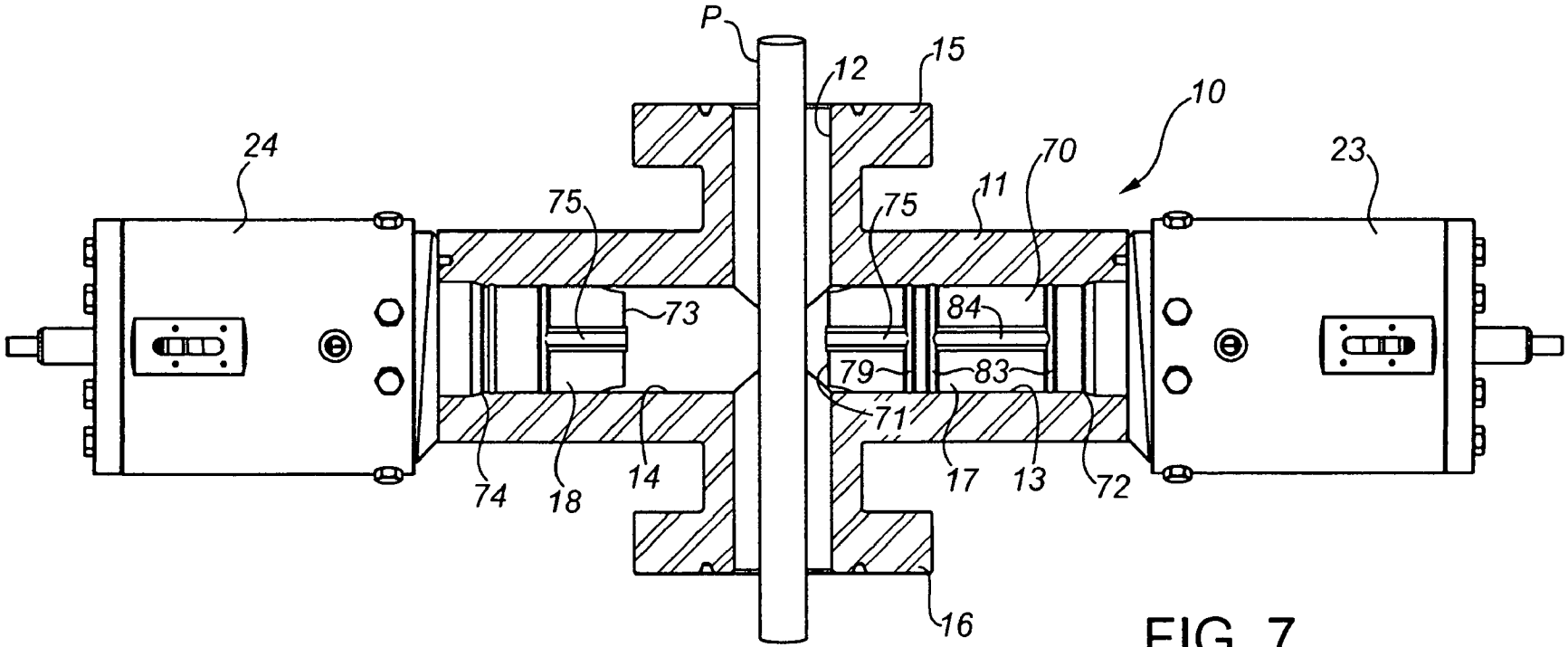
FIG. 7 is a side sectional view of an alternate BOP of this invention, shown with both BOP rams retracted (open), and in which the first and second rams are hydraulically actuated. The front ends of the rams carry elastomeric seals adapted to seal against the polish rod in a manner similar to that shown in U.S. Pat. No. 5,765,813. The seals to the central bore are as shown in FIG. 4.

Generally cylindrical first and second rams 17, 18 of the BOP 10 are shown in the Figures to be (when assembled, if in multiple parts) generally cylindrically shaped in order to seal in the ram bores 13, 14. The rams 17, 18 are locked onto the ends of ram screws 19, 20, which extend through end plugs 21, 22 at the outer ends of the ram bores 13, 14. The ram screws 19, 20 can be turned to advance or retract the rams 17, 18 into or out of the central bore 12 with mechanical screw jacks (not shown), or as shown in FIGS. 3 and 7, the ram screws 19, 20 can be advanced and retracted with hydraulic actuators 23, 24. It should be understood that the rams 17, 18 may be alternately actuated, for instance by pneumatic or electrical actuators. Actuators may be single or double acting, as known in the art. Any of these mechanical screw jacks or alternate actuators thus illustrate means for advancing and withdrawing the first and second rams 17, 18 between their open, sealing and central bore closing positions within the patent claims.

It should be understood that the ram bores 13, 14 and corresponding rams 17, 18 are not necessarily strictly cylindrical in shape. The rams and bores may take alternate shapes, such as oval in cross section, or even rectangular in cross section, as is known in the art, without departing from the present invention.

Figure 2:
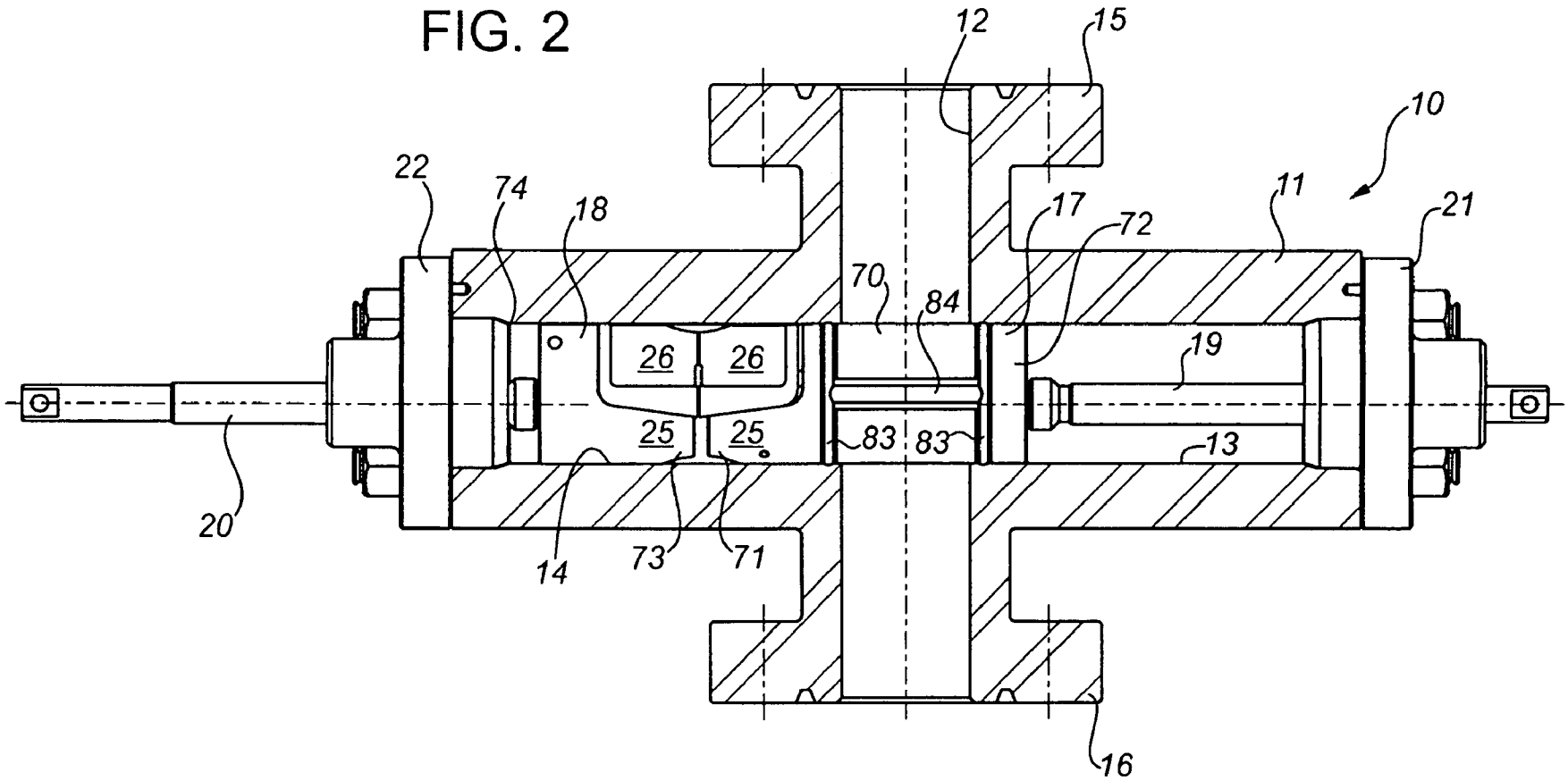
FIG. 2 is a side sectional view of the BOP of FIG. 1, but showing the first ram (on the right) in the central bore closing position to seal the central bore.

The first ram 17 (the extended ram shown on the right in the Figures) is shown to be longer or extended, relative to the needed length of the second ram 18, including an extended central bore sealing section 70 between its front and rear ends 71, 72. The second ram 18 also includes a front and rear end 73, 74. The ram bores 13, 14 are of sufficient length to accommodate the first and second rams 17, 18 in their fully retracted or fully extended positions. The rams 17, 18 are shown in FIG. 1 in their extended, sealing position, with front ends 71, 73 sealed against the polish rod P. In FIG. 2, the rams 17, 18 are shown in the central bore closing position, with the second ram 18 fully retracted, the first ram 17 fully extended, and the central bore sealing section 70 being positioned in a sealing mode across the central bore 12. The second ram bore 14 is thus of a length sufficient to include, not only the second ram 18, but also the front end 71 of the first ram 17, in this fully extended position. FIG. 3 shows the rams 17, 18 in their open, fully retracted positions, wherein fluid flow is permitted in the central bore 12.

Figure 8:
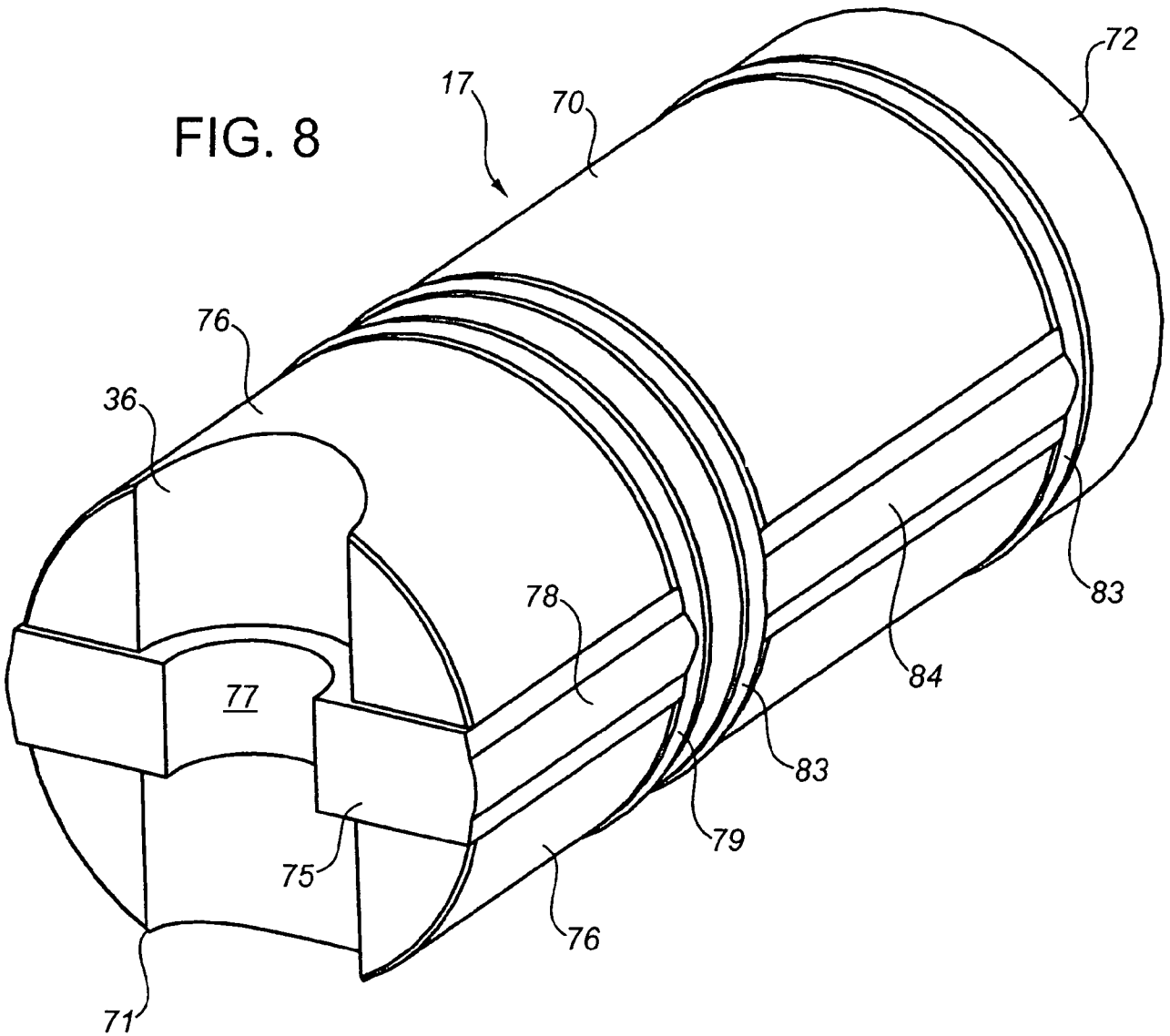
FIG. 8 is a side perspective view of the first ram of FIG. 7.
Figure 9:
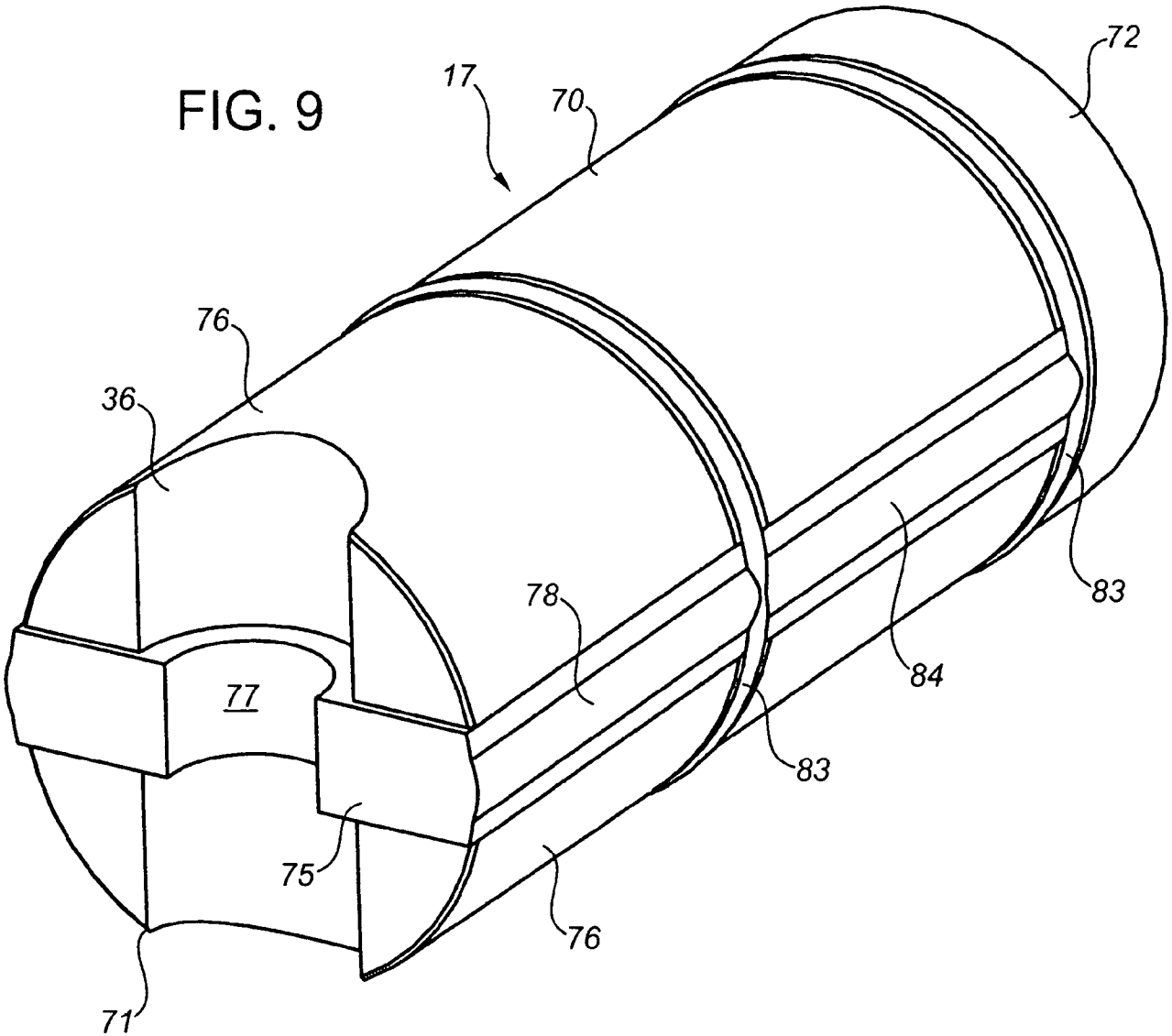
FIG. 9 is a side perspective view of a first ram which differs from that in FIG. 8 in that only two circumferential ring seals are provided.
Figure 10:
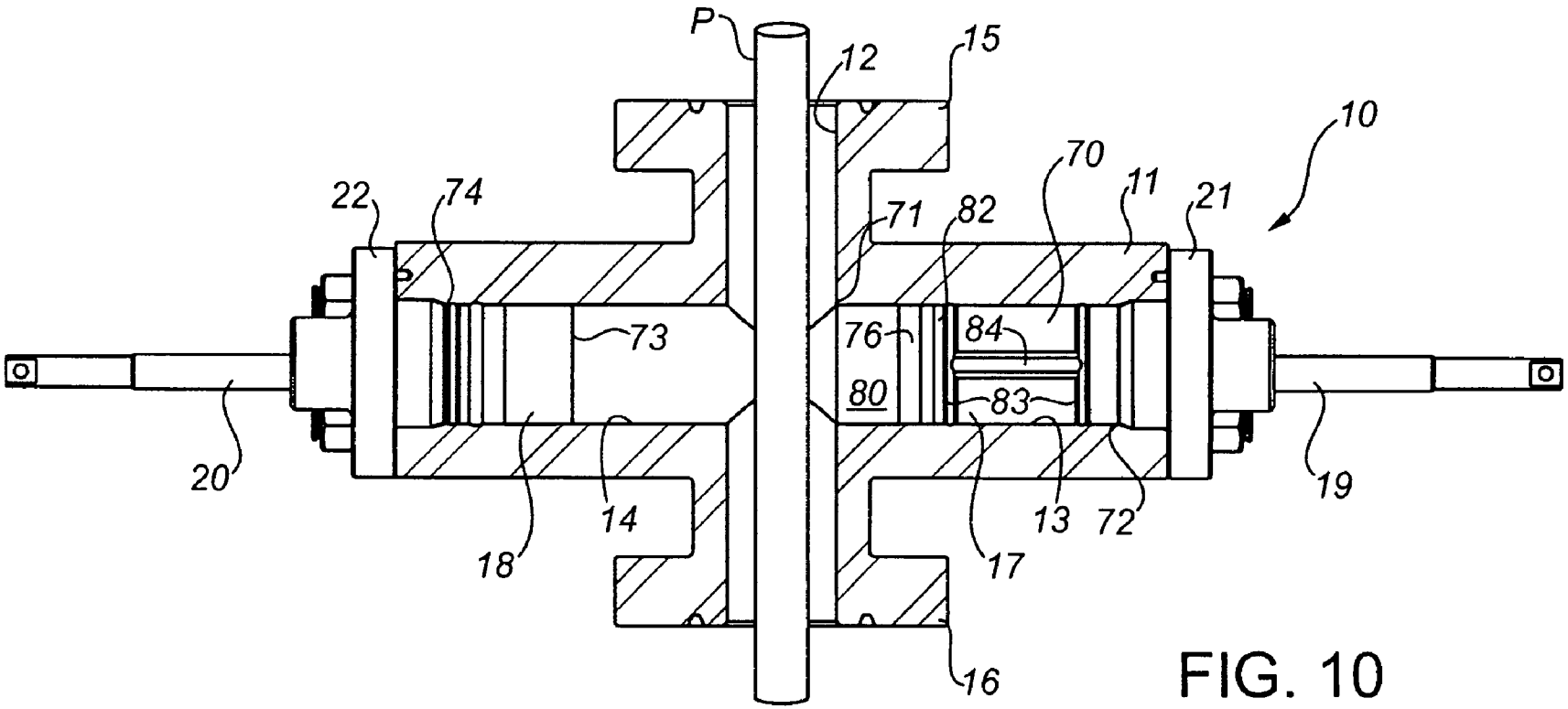
FIG. 10 is a side sectional view of an alternate BOP of this invention, shown with both BOP rams retracted (open), wherein the first and second rams are adapted at their front ends to seal against the polish rod with a molded elastomeric material or a block of thermoplastic material such as urethane or Teflon®.
Figure 11:
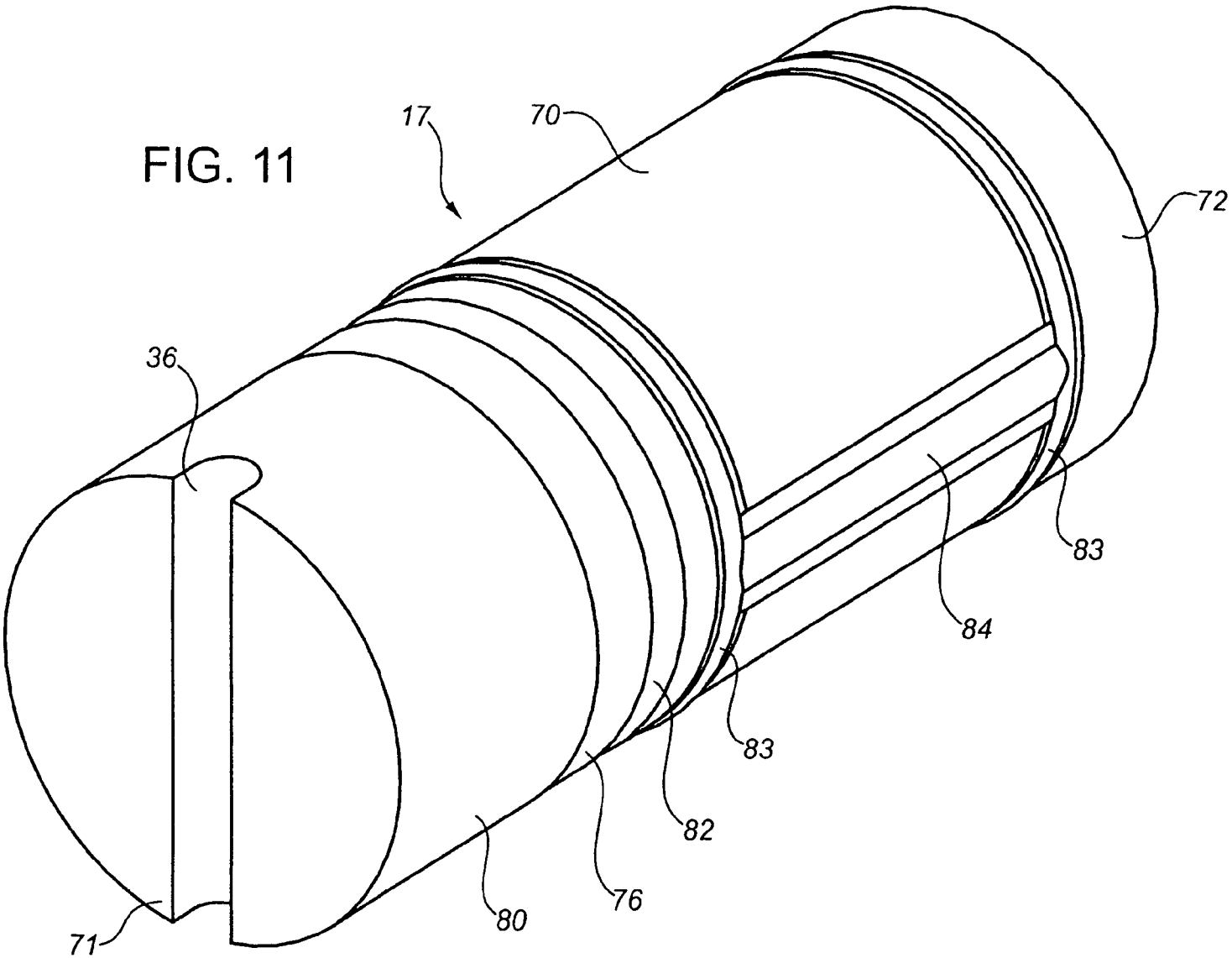
FIG. 11 is a side perspective view of the first ram of FIG. 10.

The front ends 71, 73 of the rams 17, 18 are each adapted to provide front face seals which seal against the polish rod P. Any front end sealing configuration for these BOP rams may be provided. Three embodiments of front end sealing configurations are shown in the Figures. In the embodiments of FIGS. 1-6 and 12-18, the front ends 71, 73 of the rams 17, 18 are configured to carry thermoplastic seals to seal against the polish rod, as is disclosed in U.S. Pat. No. 7,137,610. In FIGS. 7-9, the front ends 71, 73 carry elastomeric seals molded in the steel ram body, such as is disclosed in U.S. Pat. No. 5,765,813. In FIGS. 10-11, the front ends 71, 73 carry a seal formed from a block of elastomeric or thermoplastic seal, or an elastomeric coating molded at the fronts of the steel rams 17, 18.

The rams 17, 18 will be described in detail with respect to the front ends 71, 73 being configured for providing the thermoplastic seals to the polish rod P (FIGS. 1-6 and 12-18). Apart from the extended central bore sealing section 70 included for the first ram 17, the rams 17, 18 are otherwise identical, so like parts are labeled with similar numbers in the Figures.

Figure 4:
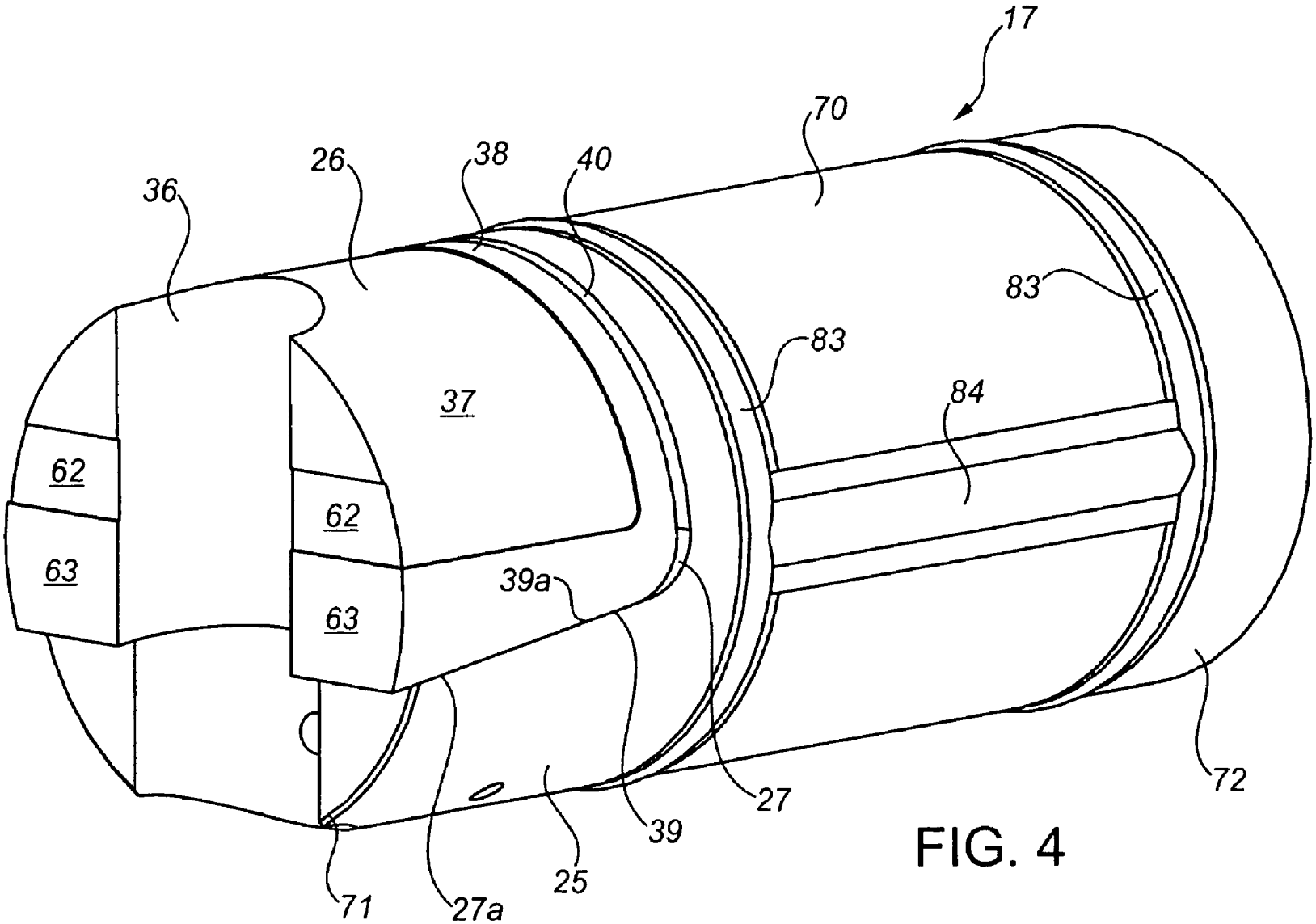
FIG. 4 is a side perspective view of the first ram of FIG. 1, showing the front end adapted for sealing with a thermoplastic seal against the polish rod in the manner disclosed in U.S. Pat. No. 7,137,610, and having an extended central bore sealing section between its front and rear ends for sealing across the central bore when in the central bore closing position. The central bore seals include a pair of circumferential ring seals and side rib seals.

Each of the rams 17, 18 is shown to consist of a steel body component 25 and a seal component 26 (see FIG. 4). In an assembled form, the rams 17, 18 are each generally cylindrical in shape for a tight fitting seal in the appropriate ram bore 13 or 14. The seal component 26 is shaped to fit into a cut-out 27 at the front of the body component 25. The cut-out 27 provides a seal support surface 27*a* to support the seal component 26 in both a vertical and horizontal direction. The cut-out portion 27 is preferably generally L-shaped, as shown herein. However, as shown in U.S. Pat. No. 7,137,610, the cut-out portion may have an alternate shape, such as a wedge shape. The rear end of the body component 25 is formed with a central T-slot 28 (see FIGS. 5, 6) to fit and lock onto the ends of each of the ram screws 19, 20. The body component 25 is generally formed from a metal such as steel. The seal component 26 is formed to provide a sealing surface of thermoplastic material to seal against the horizontal ram bore. The seal component 26 is formed either entirely from, or so as to carry a sealing material such as an insert of, a thermoplastic material. The thermoplastic material is preferably a polytetrafluoroethylene (PTFE), modified with carbongraphite or glass fillers, in order to withstand the chemicals used in well production, but other sealing thermoplastic materials may be used.

Figure 5:
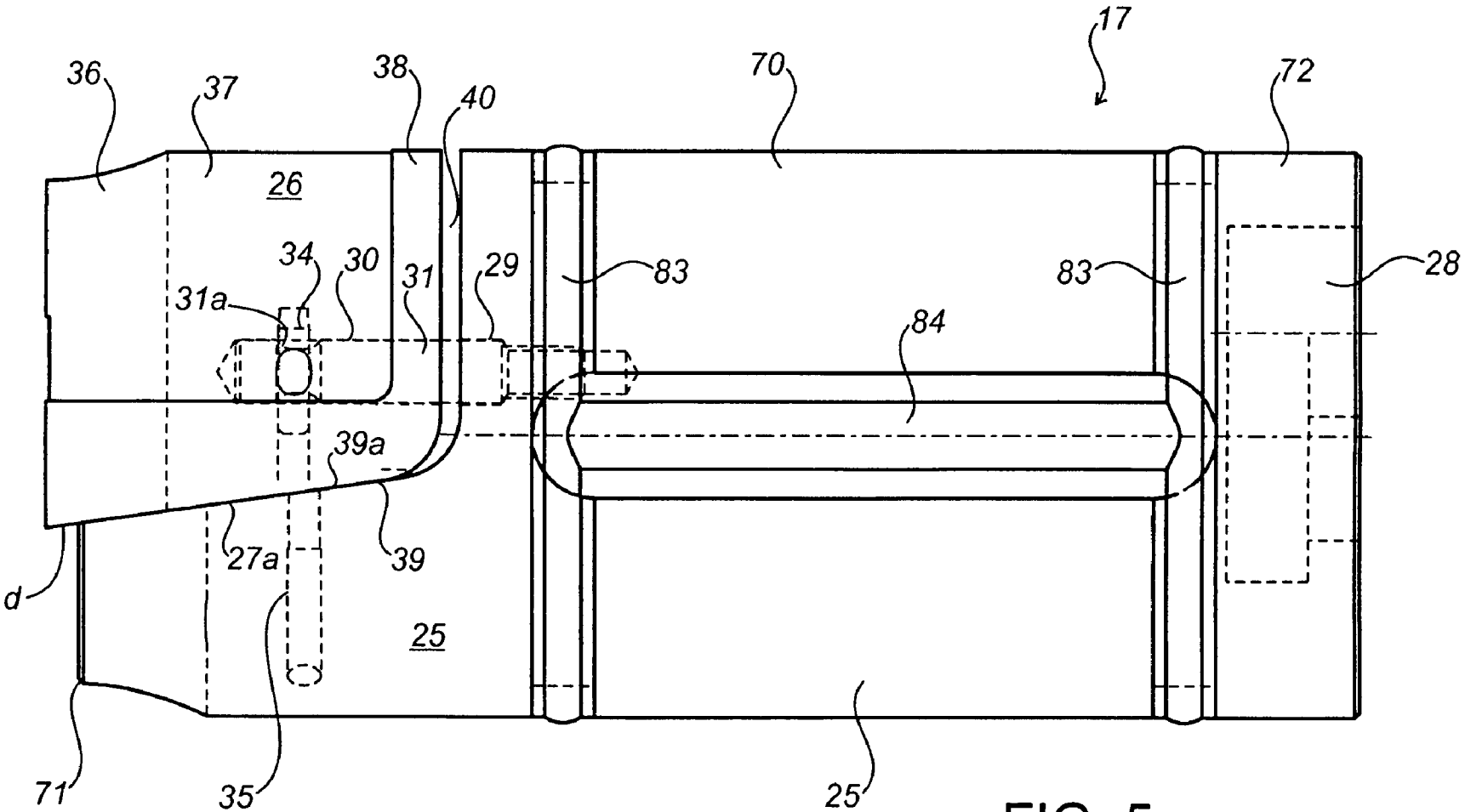
FIG. 5 is a side view of the first ram of FIG. 4, but showing in dotted outline connectors for the front thermoplastic seal component, and a T-slot for connecting to the ram screws.

Each of the body and seal components 25, 26 are formed with a pair of aligned horizontal pin bores 29, 30 respectively (see FIG. 5), to accommodate a pair of connecting pins 31. One design of the connecting pins 31 is best seen in FIG. 5 (see also U.S. Pat. No. 7,137,610), in which milled out portions (not shown) at the inner ends of the pins 31 and circumferential grooves 31*a* allow for locking into place with locking pins 34 located in vertical bores 35 formed in the seal and body components.

Each of the body and seal components 25, 26 is preferably formed with a vertical radial groove 36 that runs along the front of the assembled ram to accommodate and seal against the polish rod P. The vertical radial groove 36 may be omitted if the front ends of the rams 17, 18 are to function as blind rams to seal against each other in the event that the polish rod is not present. As shown, in its assembled and connected form with the body component 25, the front of the seal component 26 protrudes beyond the front of the body component by a distance d (FIG. 5).

The seal component 26 is generally semi-cylindrical in shape such that, when connected to the body component 25, the ram is full bore, conforming to the horizontal ram bores 13, 14. In the embodiment shown, the seal component 26 is shown formed with a reduced radius portion 37 at its outer circumference, forming a peripheral raised ridge sealing surface 38 along its outer peripheral (back and bottom) edges. As best explained below, when the rams 17, 18 are advanced into a closed position against the polish rod P, this peripheral raised ridge sealing surface 38 encircles the central bore 12 and thus functions to seal the central bore 12 when the rams 17, 18 are fully engaged against the polish rod P.

The L-shaped cut-out 27 of the body component 25 is preferably formed with a slightly inclined (front to rear) acutely angled surface 39. A similarly angled lower surface 39*a* is formed on the seal component 26, such that during sealing action, the seal component 26 rides upwardly and rearwardly on the surface 39 of the body component 25, as the rams 17, 18 are advanced to close the central bore 12. In its assembled, connected state, the seal component 26 is seated in the L-shaped cut-out 27, and a gap 40 remains at the rear of the seal component between the components 25, 26. As well, the seal component 26 protrudes horizontally at its front surface beyond the front end of the body component 25. The horizontal distance d by which the front surface of the seal component 26 protrudes beyond the body component 25 is greater than the horizontal width of the gap 40. These relative dimensions relate to the sealing action of the rams, as described below. Preferably the front sealing face 63 of each of the seal components 26 includes a cut-away portion 62, preferably in the central part of the sealing face 63, such that a reduced area of the sealing face 63 forms a better seal to the sealing face 63 of the opposing ram.

The nature of the sealing action of the present invention is important to the use of thermoplastic sealing materials along the peripheral raised ridge sealing surface 38. The rams 17, 18 seal both against the polish rod P, and outwardly against the horizontal ram bores 13, 14 to effectively seal the central bore 12 of the BOP housing 11 against high pressure from below. As the rams 17, 18 are initially advanced in the ram bores 13, 14, the protruding front surfaces 63 of the seal components 26 meet each other around the polish rod P, causing the seal components 26 to ride upwardly and rearwardly on the acutely angled surfaces 39 of the body components 25, until the gaps 40 between the seal and body components 25, 26 are closed, and the seal components 26 are pressed against the seal support surface 27*a*. Thereafter, further forward advancement of the rams 17, 18 pushes the seal components 26 forward such that their protruding front surfaces 63 seal around the polish rod P. As well, the peripheral raised ridge sealing surfaces 38 of the seal components 26 are pushed outwardly (upwardly and forwardly on the body component 25) to seal against the walls of the horizontal ram bores 13, 14.

Alternate embodiments of the front end thermoplastic seals for the rams 17, 18 are shown in U.S. Pat. No. 7,137,610, and may be used in the present invention. All such alternatives fall within the claims of this application.

The rams 17, 18 as described above include the seal component 26 above the body component 25. However, it should be apparent that the rams could be rotated such that the seal component 26 is on the bottom. Further, the body and seal components 25, 26 could be modified such that both top and bottom seal components are carried on a more generally T-shaped body component to form the cylindrical rams 17, 18. Furthermore, the components 25, 26 could be oval shaped rather than strictly cylindrical. Furthermore, the body component could be two pieces if desired. These and other modifications will be apparent to persons skilled in the art, and are intended to fall within the scope of the present invention.

Alternatively, the front end ram seals to the polish rod P may be formed of elastomeric materials such as nitrile rubber seals, as is well known for BOP rams. In FIGS. 7-9, the front ends of the rams 17, 18 are shown to include an elastomeric seal 75 molded into grooves (not shown, but located below the seal 75) formed in the steel ram body 76. The front seal face portion 77 of seal 75 protrudes from the front of the ram 17, 18 to seal against the polish rod P. The seal 75 preferably includes longitudinal side rib portions 78 which extend radially outwardly from the sides of the steel ram body 76. The seal 75 also preferably includes a circumferential ring seal portion 79 at its rear end 74 (in the case of second ram 18) or adjacent the extended central bore sealing section 70 (in the case of the first ram 17). This circumferential ring seal portion 79 seals the rams 17, 18 against the ram bores 13, 14. The rams 17, 18 include, at their front ends 71, 73, the vertical radial groove 36 formed in both the steel ram body 76 and in the seal 75 to accommodate the polish rod P.

Alternatively, as shown in FIGS. 10-11, the front end ram seals to the polish rod P may be formed such that the front of the steel ram body 76 is provided with a molded surface of an elastomeric material, or is connected to a block of stiff thermoplastic material (both are generally shown at 80), such as urethane. As above, the front ends 71, 73 of the rams 17, 18 are formed with the vertical radial groove 36 to accommodate the polish rod P. As shown in FIG. 11, the ram 17, 18 preferably includes a circumferential seal 82 at its rear end 74 (for second ram 18) or adjacent the extended central bore sealing section 70 (for ram 17).

The extended central bore sealing section 70 of the first ram 17 is shown with alternate types of seals for sealing across the central bore 12 when the ram 17 is in the central bore closing position, as described below.

In FIGS. 1-5 and 7-12, the ram 17 is shown to carry elastomeric seals in the central bore sealing section 70, configured with a pair of circumferential ring seals 83 and a pair of rib seals 84. The ring seals 83 are spaced from each other along the central bore sealing section 70 such that they span the central bore 12 when in the central bore closing position, and thus seal in each of the ram bores 13, 14 against pressure from the central bore 12. The rib seals 84 extend longitudinally between the ring seals 83 and extend radially outwardly from the ram body 25. When in the central bore closing position, the rib seals 84 span and seal the central bore 12 along the sealing surfaces formed across the wall surface of the central bore 12 at the intersection with the ram bores 13, 14. It will be noted that the rams 17, as shown in FIGS. 8 and 9, differ from each other in that the front circumferential ring seal 79 shown in FIG. 8 is omitted in FIG. 9, having been replaced by the circumferential ring seal 83 of the central bore sealing section 70.

Figures 6A, 6B:
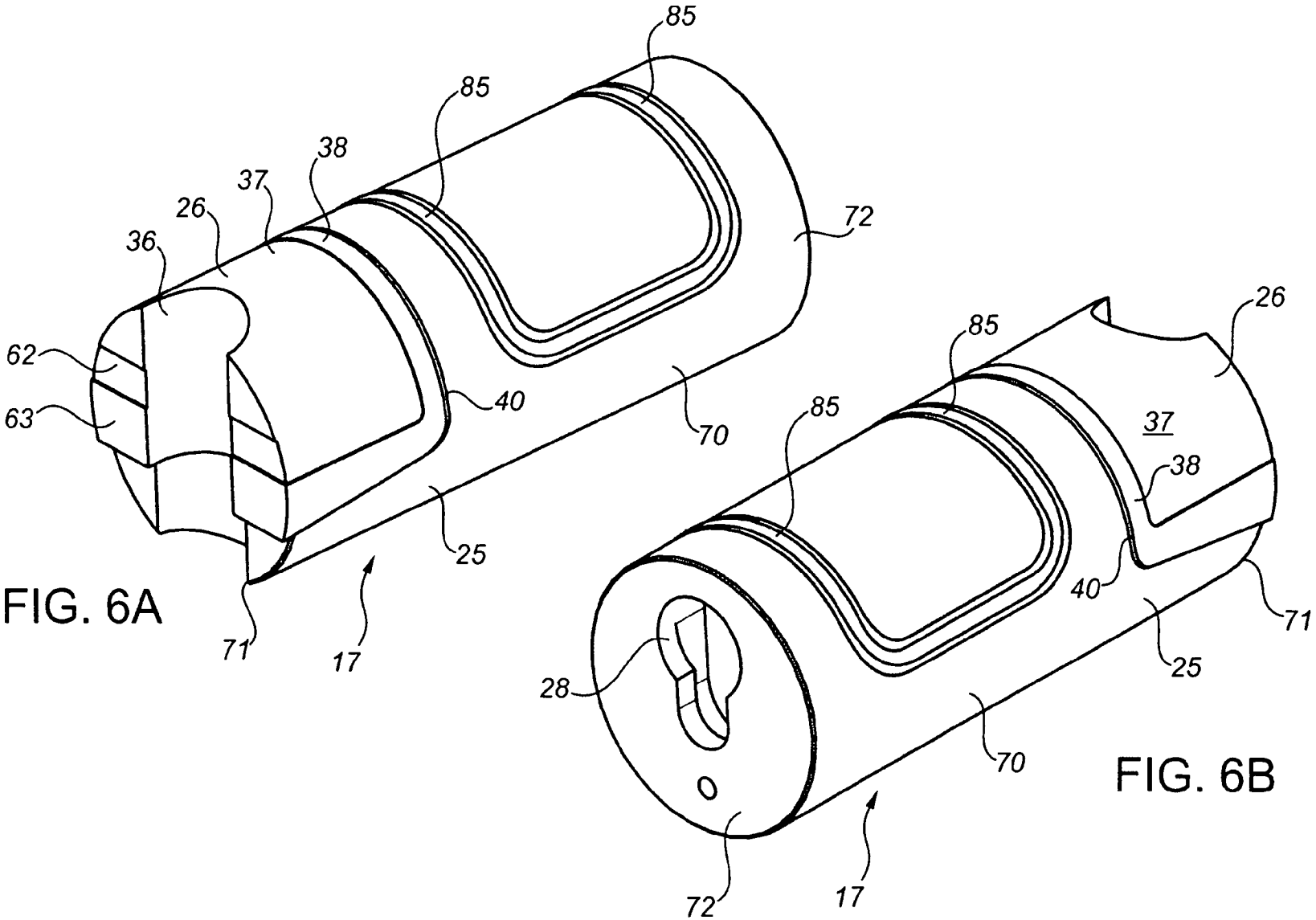
FIGS. 6A and 6B provide two views, front (6A) and rear (6B) perspectives, of an alternate first ram of the present invention, in which the extended central bore sealing section includes a central bore seal which is a saddle shaped circumferential seal sized to seal the central bore when in the central bore closing position.

In FIG. 6, a ram 17 is shown to carry elastomeric seals in the central bore sealing section 70, configured as a saddle shaped seal 85 (i.e., extending down and along the sides of the upper cylindrical surface of the ram 17 in a saddle-like manner). The saddle seal 85 is formed in grooves (not shown) on the upper surface of the central bore sealing section 70, and is shaped and sized to span and seal against the sealing surfaces formed at the intersection of the central bore 12 and ram bores 13, 14 when in the central bore closing position.

In FIGS. 13-16, a ram 17 is shown to include a thermoplastic seal configured as a saddle shaped seal 86 in the central bore sealing section 70. As in FIG. 6, the saddle seal 86 is formed in grooves (not shown) on the upper surface of the central bore sealing section 70, and is shaped and sized to span and seal against the sealing surfaces formed at the intersection of the central bore 12 and ram bores 13, 14 when in the central bore closing position. However, being formed of a thermoplastic material, in order to effect the seal to the central bore 12, a means for upwardly lifting the extended bore sealing section 70 as it moves into its central bore closing position, is included. To that end, front and rear spaced, downwardly projecting feet 87, 88 are formed at the lower surface of the extended central bore sealing section. It should be understood that the term "feet", as used herein and in the claims, includes alternate lifters, for example longitudinally extending stepped ridges. The front foot 87 is slightly shorter than rear foot 88. Channels 89, 90 are formed in each of the ram bores 13, 14 to accommodate the feet 87, 88. As shown, the channels 89, 90 are stepped adjacent the central bore (see steps A, B, and C in FIG. 15, with the rams removed but with lines showing the progressive heights of the three steps). The stepped channels 89, 90 at the central bore 12 are located and sized to lift the central bore sealing section 70, and thus the saddle seal 86, as the feet 87 and 88 simultaneously engage and rise on steps A and B respectively. Thus, in the central bore closing position shown in FIG. 13, the thermoplastic saddle seal 86 is lifted upwardly to seal the central bore 12.

Figure 17:
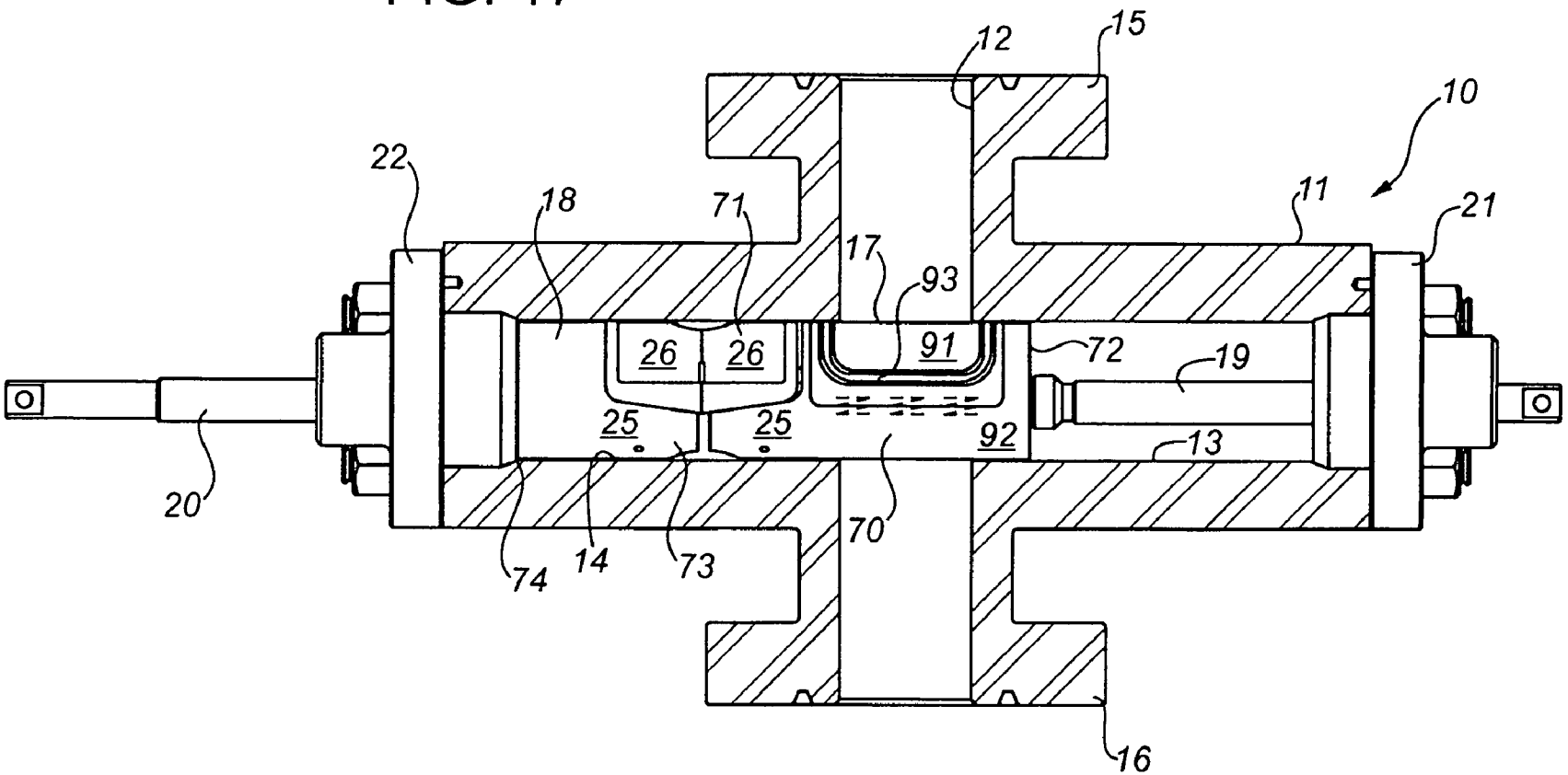
FIG. 17 is a side sectional view of an alternate embodiment of the invention wherein the first ram includes spring biased parts as lifting means at the extended central bore sealing section to upwardly seal against the central bore.

In FIG. 17, the extended central bore sealing section 70 of the steel ram body component 25 is formed in two separate parts 91, 92, with the top section 91 carrying a thermoplastic saddle seal 93, much as described above. Upwardly biasing springs (shown schematically as dotted lines in FIG. 17) are positioned between the parts 91, 92 such that the thermoplastic saddle seal 93 is lifted upwardly to seal against the central bore 12 in the central bore closing position.

Figure 18:
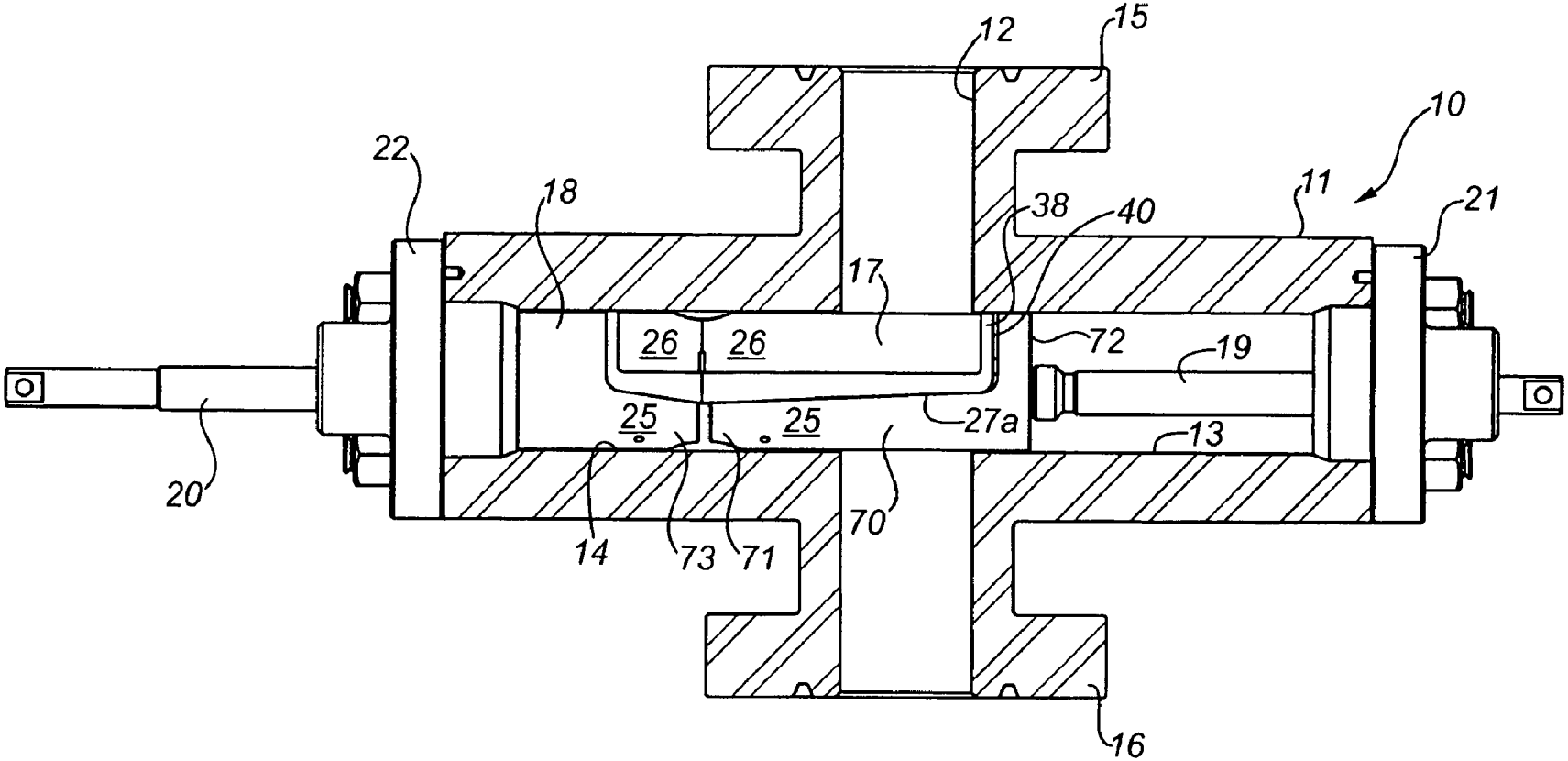
FIG. 18 is a side sectional view of a further alternate embodiment of the invention wherein the first ram is adapted to provide thermoplastic seals at both its front end and in the central bore sealing section by extending the front body component and the seal component to the rear end of the first ram, such that, when in central bore sealing position, the front end of the seal component contacts the second ram causing the seal component to be pressed against the seal support surface of the body component such that the thermoplastic sealing surface is compressed outwardly to seal against the central bore and to seal the central bore.

In FIG. 18, the front seal components described above for FIGS. 1-6, including the body component 25 and the seal component 26, extend across the central bore sealing section 70 to the rear end 72 of the first ram 17. This effectively provides yet another means to upwardly lift the thermoplastic seal component when the front ends 71, 73 of the two rams 17, 18 contact each other in the central bore closing position. The seal component 26 is pressed against the seal support surface 27*a* of the body component 25 such that the upper surface of the seal component 26, and the raised ridge 38 (thermoplastic sealing surface) is compressed outwardly to seal against the central bore 12 and the ram bores 13, 14.

Figure 12:
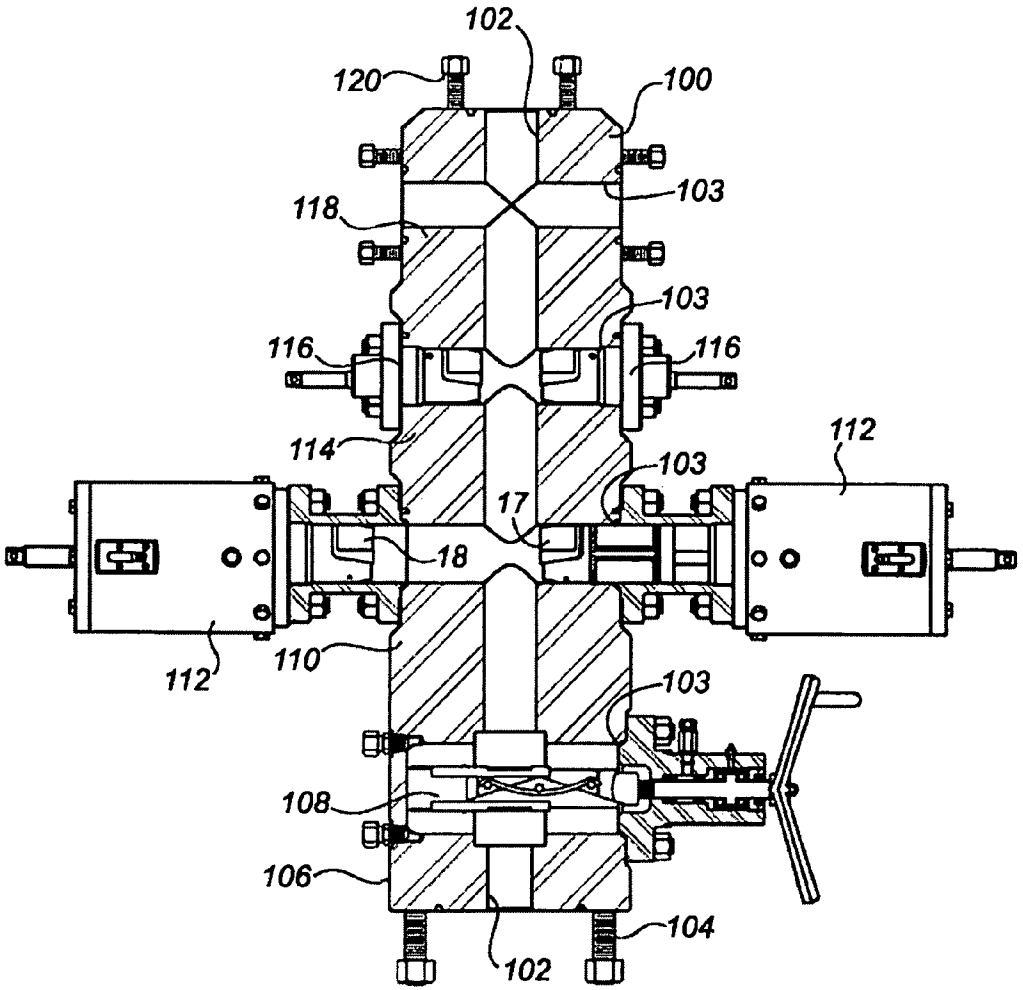
FIG. 12 is a side view, partially in section, of a wellhead assembly of this invention having as components of an integral composite pumping tree, from the bottom to the top, a master gate valve, a central bore closing BOP of this invention as shown in FIG. 1, a BOP as disclosed in U.S. Pat. No. 7,137,610, and the profile for a flow tee (sequence of components may vary).
Figure 13:
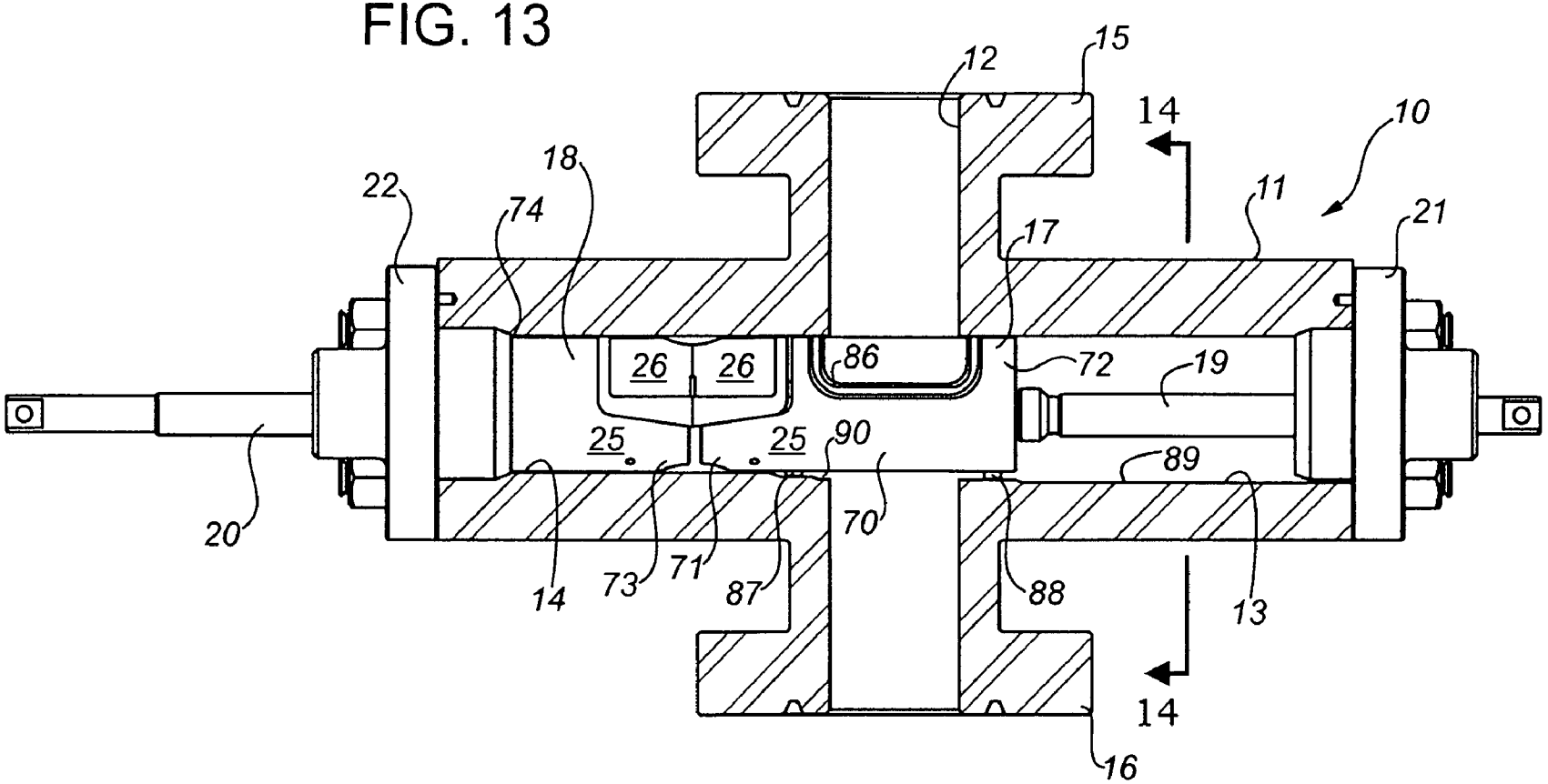
FIG. 13 is a side sectional view of an alternate BOP of this invention, shown in the central bore closing position without the polish rod, and in which the rams differ from those shown in FIG. 1 in that the saddle shaped central bore seal in the extended central bore sealing section is a thermoplastic seal.
Figure 14:
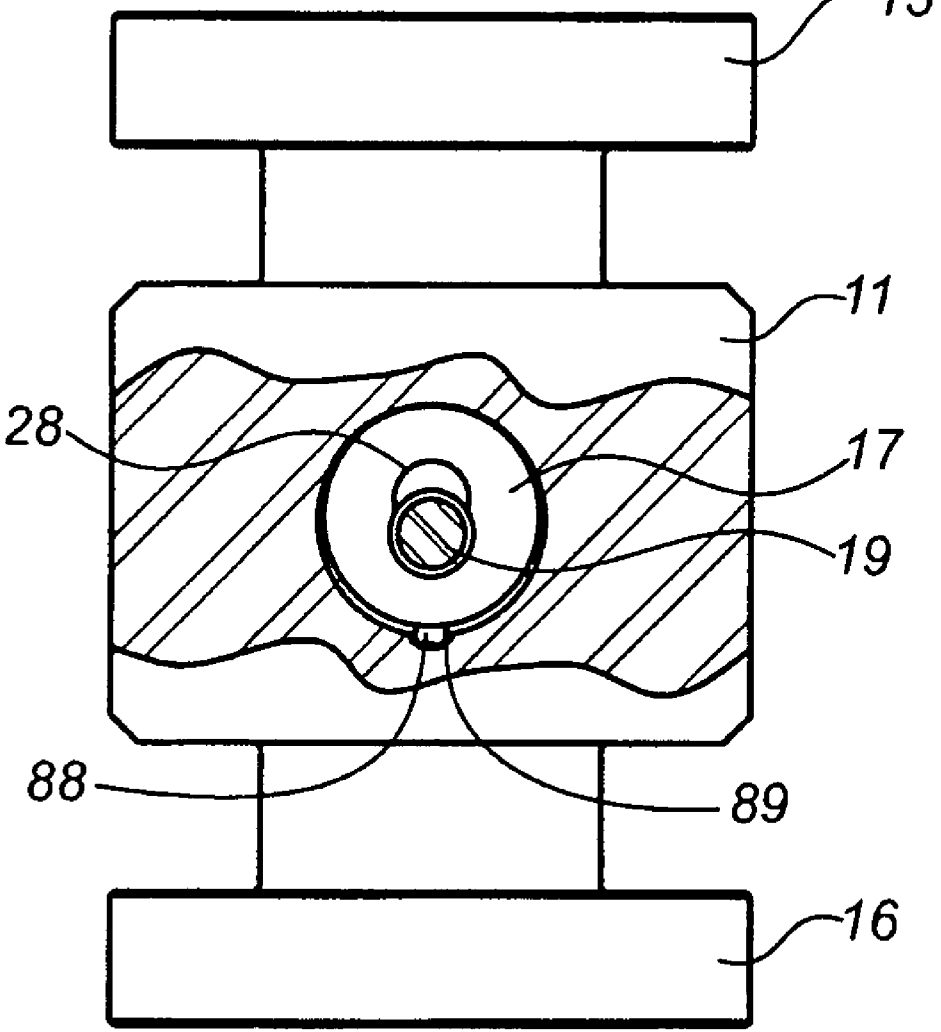
FIG. 14 is an end view of the first ram of FIG. 13, taken along line 14-14, partially in section to show one of the feet and one of the stepped channels used to lift the thermoplastic saddle seal into a sealing position in the central bore.
Figure 15:
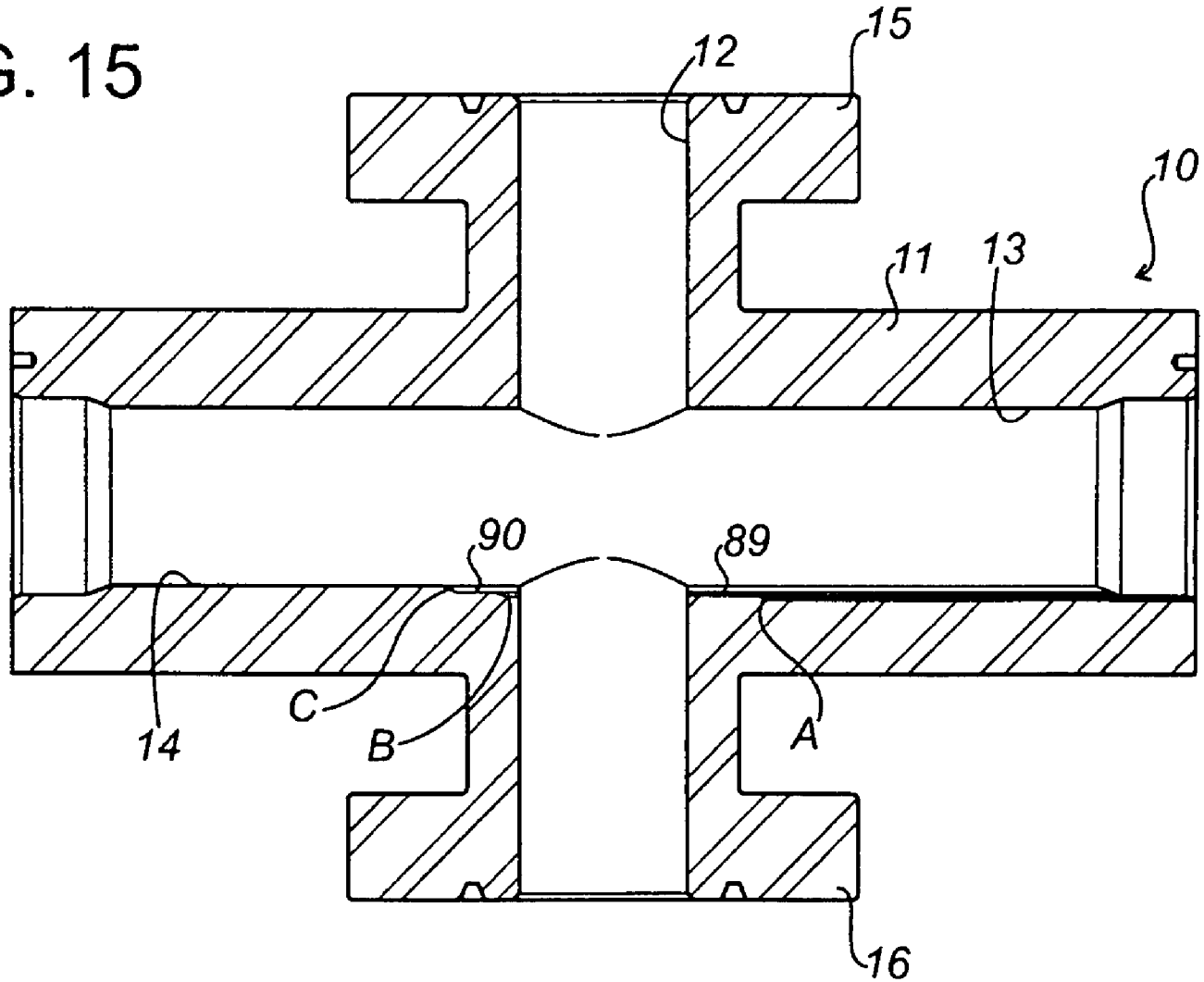
FIG. 15 is a side sectional view of the BOP of FIG. 13, with the rams removed to show extra lines along the ram bores to illustrate the progressive steps in the channels along the ram bores.
Figure 16:
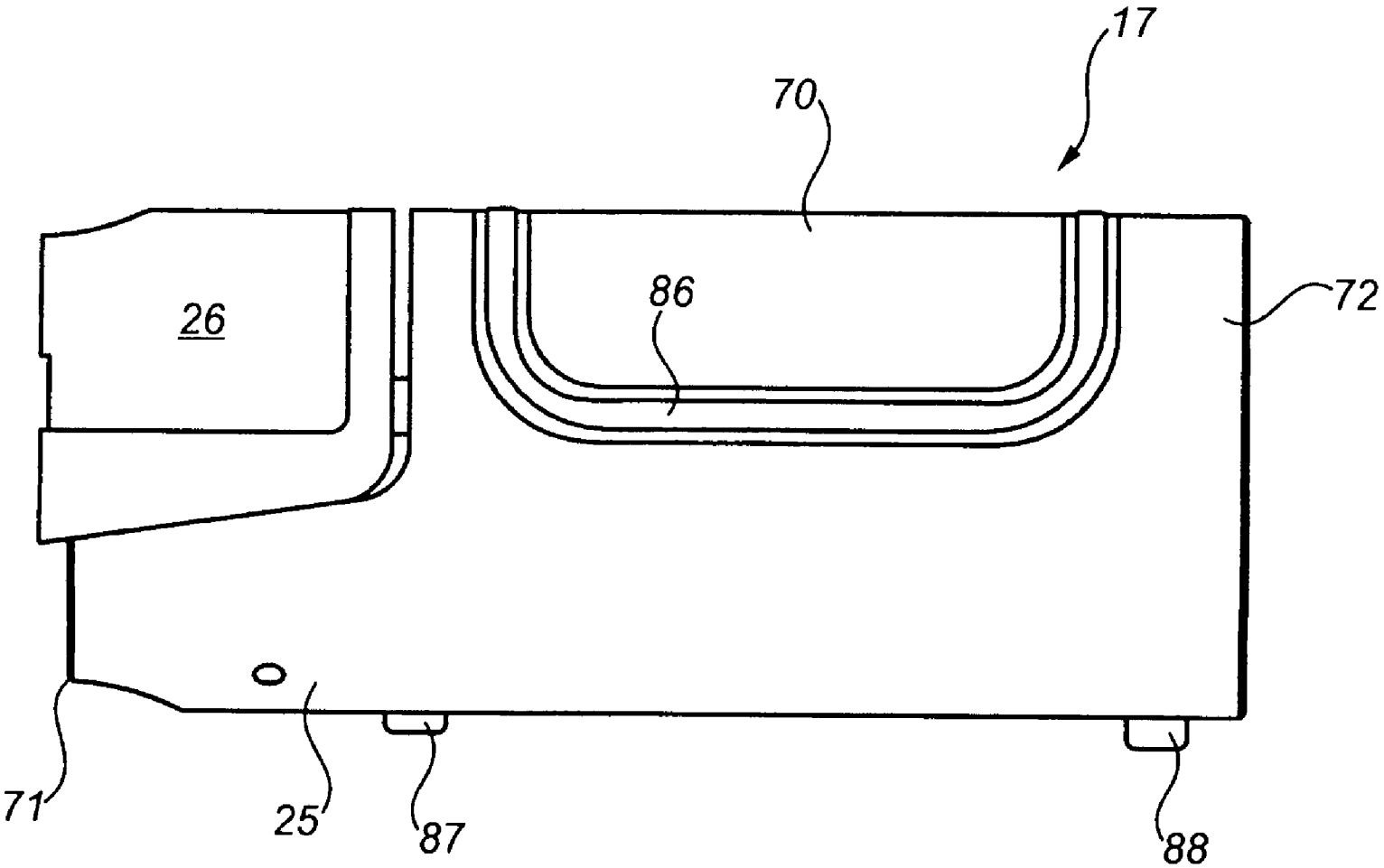
FIG. 16 is a side view of the first ram of FIG. 13, showing the spaced feet.

The invention also extends to a composite wellhead assembly including, between its top connector and bottom connector, a blowout preventer as described above, together with one or more of the following components, in any sequence, adapters, valves, gate valves, flow tee, additional blowout preventers, and polish rod clamp. To that end, attention is directed to the devices disclosed in the following U.S. Patents, all of which are commonly owned by Stream-Flo Industries Ltd.: U.S. Pat. No. 5,743,332, issued Apr. 28, 1998, entitled "Integral Wellhead Assembly for Pumping Wells"; U.S. Pat. No. 6,457,530, issued Oct. 1, 2002, entitled "Wellhead Production Pumping Tree"; U.S. Pat. No. 6,176,466, issued Jan. 23, 2001, entitled "Composite Pumping Tree with Integral Shut-Off Valve"; and U.S. Pat. No. 6,595,278, issued Jul. 22, 2003, entitled "Assembly for Locking a Polished Rod in a Pumping Wellhead". Each of these patents discloses wellhead equipment used in connection with pumping oil wells, but in a composite form, meaning that one or more functional components of a conventional pumping tree are included in an integral body housing between a top and a bottom connector. Such components may include a shut off valve, a blowout preventer, a flow tee and an adapter. FIG. 12 shows one such composite wellhead assembly in accordance with this invention to include an integral tubular body 100, formed from a single piece of steel, and forming an axial, vertical or central fluid flow bore 102 extending therethrough. Multiple side openings 103 are formed in the body 100, each communicating with the vertical bore 102, in order to house the valve, BOP and flow tee components, as set forth below. The body 100 includes a bottom connector 104 for connection with the component located therebelow (not shown, but for example the flanged top connection of a tubing head). Although shown as a studded down connection, the bottom connector can be any type of bottom connector such as a flanged connection, clamp-hub connection, rotatable flange connection, welded connection or threaded connection. The body 100 includes a valve housing section 106 above the bottom connection housing a conventional gate valve assembly 108, operative to open or close the bore 102. Above the valve housing section 106 is a first BOP housing section 110, which houses the ram assembly components 112 of FIG. 1, as described above. The ram assembly components of any of the above described embodiments of this invention may be used in this section 110. A second BOP housing section 114 is formed in the body 100 above the first BOP housing section 110. As shown in FIG. 12, ram assembly components 116 are shown carrying thermoplastic seal components as described in U.S. Pat. No. 7,137,610. Any other BOP ram assembly components may be substituted in this section 116. Above the second BOP housing 114 is a flow tee housing section 118 for connection with a conventional flow line (not shown), through which well fluid is produced. The body 100 forms a top connector 120 at its upper end for connection with the wellhead component located thereabove, typically a stuffing box (not shown). FIG. 12 shows the top connector 120 as studded connectors, but any other type of connector may be substituted, as known in the art. As indicated, this is only one exemplary composite wellhead assembly. The components may be provided in different sequences, and may be varied, added or omitted as is appropriate for the needs of a particular wellhead.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention. One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

What is claimed is:

1. A production blowout preventer, comprising:

a housing forming a central bore, which extends vertically through the housing, and a first and a second horizontal ram bore extending radially outwardly in opposite directions through the housing and intersecting the central bore, with sealing surfaces being formed across the wall surfaces at the intersection of the ram and central bores;

a first ram positioned in the first ram bore for sliding movement therealong;

a second ram positioned in the second ram bore for sliding movement therealong;

the first and second rams each including a ram body having front and rear ends, each of the ram bodies being slidable along the ram bores so as to project into the central bore where their front ends are adapted to seal against a polish rod of a rod string extending therethrough;

the first ram body including an extended central bore sealing section between its front and rear ends, said central bore sealing section carrying one or more central bore seals for sealing across the central bore when the extended central bore sealing section is positioned across the central bore in a central bore closing position;

the one or more central bore seals including a saddle shaped seal of a thermoplastic material formed on the upper surface of the extended central bore sealing section and being shaped to span and seal across the central bore when in the central bore closing position;

the first ram carrying lifting means for upwardly lifting the extended central bore sealing section to cause the saddle shaped thermoplastic seal to seal across the central bore in the central bore closing position;

the first ram bore being of sufficient length to accommodate the first ram body in its fully extended or fully retracted position;

the second ram bore being of sufficient length to accommodate the second ram body in its fully extended or fully retracted position, and to also accommodate the front end of the first ram when in the central bore closing position; and means connected to the rear of each ram body for advancing and withdrawing the first and second rams between open, sealing and central bore closing positions.

2. The blowout preventer of claim 1, wherein:

the first and second ram bodies are generally cylindrical; and the one or more central bore seals on the first ram includes a pair of circumferential ring seals positioned on the extended central bore sealing section, said circumferential ring seals being spaced sufficiently to span the central bore when in the central bore closing position, so as to also seal the first and second ram bores against pressure from the central bore; and the first ram includes a pair of rib seals on its outer surface extending radially outwardly therefrom and extending longitudinally between the circumferential ring seals, said rib seals being positioned to seal the central bore when in the central bore closing position.

3. The blowout preventer of claim 2, wherein the front ends of the first and second rams are adapted to provide thermoplastic seals to the polish rod.

4. The blowout preventer of claim 2, wherein the front ends of the first and second rams are adapted to provide elastomeric seals to the polish rod.

5. The blowout preventer of claim 2, wherein the front end of the first and second rams is adapted to seal against each other across the central bore when the polish rod is not present.

6. The blowout preventer of claim 1, wherein:

the first and second ram bodies are generally cylindrical.

7. The blowout preventer of claim 6, wherein the front ends of the first and second rams are adapted to provide thermoplastic seals to the polish rod.

8. The blowout preventer of claim 7, wherein the lifting means includes front and rear spaced, downwardly projecting feet formed at a lower surface of the extended central bore sealing section, and a channel formed in each of the first and second ram bores to accommodate the feet, each of the channels being progressively stepped at the central bore to force the saddle shaped seal upwardly to seal the central bore as the feet simultaneously engage the steps in the central bore closing position.

9. The blowout preventer of claim 7, wherein the lifting means includes;

the extended central bore sealing section being formed in separate top and bottom parts, with the top part carrying the saddle shaped thermoplastic seal; and one or more upwardly biasing springs positioned between the top and bottom parts such that the thermoplastic saddle shaped seal is lifted upwardly to seal across the central bore in the central bore closing position.

10. The blowout preventer of claim 7, wherein the first and second ram bodies each has a front end adapted to provide thermoplastic seals to the polish rod, and wherein each of the first and second ram bodies comprises:

a body component with front and rear portions and ends;

a seal component with front and rear portions and ends;

said body component having an arcuate longitudinal outer surface for conforming with the horizontal ram bore surfaces, and having a cut-out in its front portion which provides a seal support surface to support the seal component in both a vertical and horizontal direction;

said seal component having an arcuate longitudinal outer surface for conforming with the horizontal ram bore surfaces, and an inner surface which generally conforms to the seal support surface of the body component;

said body component and seal component combining, in an assembled form, to form a full bore ram body, which when out of sealing engagement has the front end of the seal component protruding a horizontal distance beyond the front end of the body component;

connectors for connecting the seal and body components while allowing the seal component, during sealing engagement, to be pressed against the seal support surface of the body component; and said seal component providing a sealing surface formed of thermoplastic material around the arcuate outer surface for sealing against the horizontal ram bore;

so that, as the body component is advanced forwardly into a sealing engagement causing the front end of the seal component to contact either the adjacent ram or the polish rod to seal off the central bore, the seal component is pressed against the seal support surface of the body component such that the thermoplastic sealing surface is compressed outwardly to seal against the horizontal ram bore.

11. The blowout preventer of claim 10, wherein the body and seal components of the first ram extend across the extended central bore sealing section to the rear end of the first ram, such that when in central bore closing position, the front end of the first ram seal component contacts the second ram causing the first ram seal component to be pressed against the seal support surface of the first ram body component such that its thermoplastic sealing surface is compressed outwardly to seal across the central bore.

12. The blowout preventer of claim 6, wherein the front ends of the first and second rams are adapted to provide elastomeric seals to the polish rod.

13. The blowout preventer of claim 6, wherein the front end of the first and second rams is adapted to seal against each other across the central bore when the polish rod is not present.

14. The blowout preventer of claim 1, wherein the housing provides top and bottom connectors for connecting and sealing to wellhead components located above and below the housing.

15. A composite wellhead assembly including, between its top connector and bottom connector, the blowout preventer of claim 1, together with one or more of the following wellhead components, in any sequence: an adapter, a valve, a gate valve, a flow tee, a blowout preventer, and a polish rod clamp.

16. The blowout preventer of claim 1, wherein each of the ram bodies carries one or more seals for sealing against the ram bore in which it is positioned.

* * * * *